US006550882B2

(12) United States Patent
Koitabashi et al.

(10) Patent No.: US 6,550,882 B2
(45) Date of Patent: Apr. 22, 2003

(54) INK JET PRINTING APPARATUS

(75) Inventors: Noribumi Koitabashi, Kanagawa (JP); Tsutomu Kawai, Kanagawa (JP); Tadashi Matsumoto, Tokyo (JP); Hitoshi Tsuboi, Tokyo (JP); Haruhiko Koto, Tokyo (JP); Yasunori Fujimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,223

(22) Filed: Nov. 14, 2001

(65) Prior Publication Data

US 2002/0167576 A1 Nov. 14, 2002

(30) Foreign Application Priority Data

Nov. 17, 2000 (JP) ..... 2000-351999
Nov. 17, 2000 (JP) ..... 2000-352004

(51) Int. Cl.[7] ..... B41J 25/308

(52) U.S. Cl. ..... 347/8; 347/101; 347/104; 347/43; 347/34

(58) Field of Search ..... 347/100, 102, 347/104, 101, 34, 21, 25, 22, 43, 8

(56) References Cited

U.S. PATENT DOCUMENTS 5,949,451 A * 9/1999 Takagi ..... 347/43

FOREIGN PATENT DOCUMENTS

| | | | | |
|---|---|---|---|---|
| EP | 0790129 A2 * | 8/1997 | ..... | B41J/2/165 |
| EP | 0926212 A2 * | 6/1999 | ..... | C09D/11/00 |
| JP | 54048552 A * | 4/1979 | ..... | 347/43 |

* cited by examiner

*Primary Examiner*—John Barlow
*Assistant Examiner*—Manish S. Shah
(74) *Attorney, Agent, or Firm*—Fitzpatrick, Cella, Harper & Scinto

(57) ABSTRACT

In an ink jet printing apparatus that performs printing by using an ink and a processing liquid that renders the ink insoluble, an effect the mist of the processing liquid or substances insolubilized by it has on the ejection performance of the ink head or processing liquid head is reduced. The distance between the processing liquid head 101S and the print paper 103 carried by the belt 111 is set larger than the head-to-paper distances of other heads 101Bk, 101C, 101M, 101Y. As a result, the mist generated by the ejection of the processing liquid from the head 101S diffuses in a recessed space formed by the heads 101Bk and 101C on both sides of the head 101S and thus hardly reaches the ink nozzle surfaces of these heads on both sides.

11 Claims, 12 Drawing Sheets

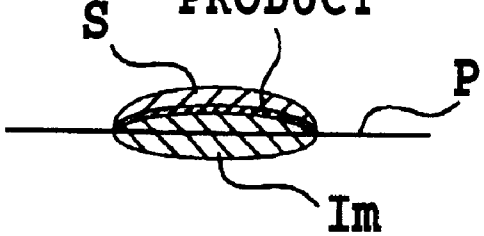
FIG.12A
FIG.12B
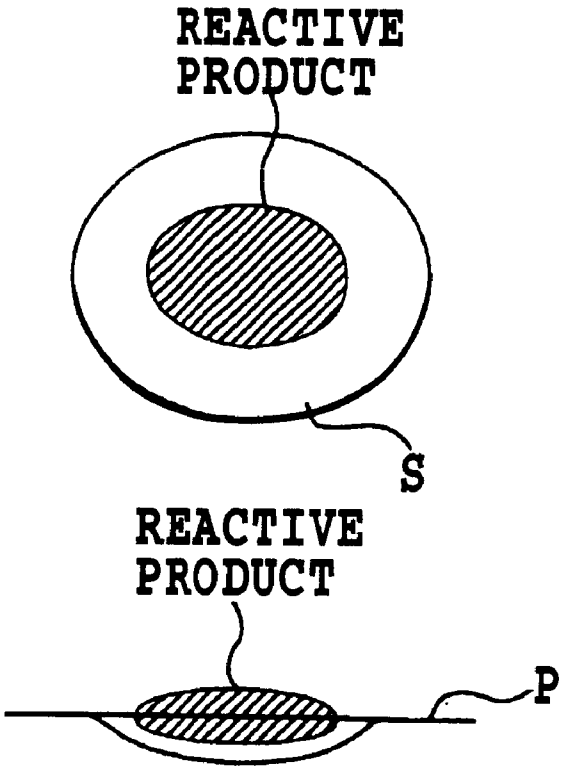
FIG.12C

INK JET PRINTING APPARATUS

This application is based on Patent Application Nos. 2000-351999 and 2000-352004 both filed Nov. 17, 2000 in Japan, the content of which is incorporated hereinto by reference.

BACKGROUND OF THE INVENTION

1. Field of the Invention

The present invention relates to an ink jet printing apparatus. More specifically, the present invention relates to a system for minimizing an effect the mist of ink, processing liquid for rendering the ink insoluble or insolubilized substance has on an ejection performance of print heads during a printing process that uses the ink and the processing liquid, the mist being produced as a result of injecting the ink and the processing liquid.

2. Description of the Related Art

The processing liquid that renders ink insoluble basically contributes to improving the water resistance of a printed image. The processing liquid is ejected onto the same areas of a print medium where the ink droplets have landed so that droplets of the processing liquid overlap the ink dots, or onto those areas adjacent to the ink dots so that they partly contact the ink dots. The resulting mixing of the ink and the processing liquid causes a colorant in the ink to become insoluble. The ink fixed on the print medium in this way has improved water resistance because of its insolubility.

In addition to this purpose, the processing liquid is also used to improve the quality of a printed image. In this regard, the applicant of this invention has made a variety of proposals. For example, the processing liquid is effective for preventing feathering and spreading of ink and for improving the density.

The processing liquid is ejected by using ordinary print heads similar to those used for ink. In the case of a serial type printer, for example, a processing liquid head is mounted on a carriage along with black, cyan magenta and yellow heads. As the carriage moves, the ink or the processing liquid is ejected onto the print medium from respective heads in the order of their arrangement. In a printer with so-called full-line type heads each having ejection nozzles arrayed over a range corresponding to a width of the print medium, the processing liquid head and the ink ejecting heads are arranged at predetermined intervals in the print medium feed direction. The processing liquid is ejected after each feeding of the print medium, resulting in the processing liquid being mixed with the ink on the print medium as described above.

In the ink jet printing apparatus using the processing liquid, however, because the processing liquid renders the ink insoluble, insolubilized substances not directly involved in the printing are produced and may have a variety of adverse effects on the printing.

To describe in more detail, when the processing liquid is ejected from the head, not only are droplets formed that are intended to land on the print medium but much smaller droplets or mist are also produced. The mist of the processing liquid, because it has relatively small mass and speed, may not reach the print medium but float and adhere directly to the nozzle surfaces of other heads. The nozzle surface is a surface of the print head in which the ink ejection nozzles are arranged. When the floating mist of the processing liquid adheres to the nozzle surfaces and reacts with the ink in or around the nozzles to form insoluble substances, ejection troubles may arise such as ink ejection failures, insufficient amounts of ink ejected and deviations of ink ejection directions.

The processing liquid mist may also be produced by a part of the ejected processing liquid droplets bouncing off the print medium when they land on it. Such bounced-off mist of the processing liquid may adhere to other heads, leading to similar ejection failures.

SUMMARY OF THE INVENTION

The ejection failure due to the insolubilized substances may be forestalled by performing ejection performance recovery operations, such as wiping, preliminary ejection and nozzle suction by vacuum, to remove the unwanted mist adhering to the nozzle surface. However, since these recovery operations are not able to be performed during the printing operation, they basically lower the throughput of the print output. Hence, on top of the ordinary ejection performance recovery operations, executing additional operations for eliminating the ejection troubles due to the mist described above may bring about an unacceptable, significant reduction in the throughput.

The present invention has been accomplished to solve the above-described problems and provides an ink jet printing apparatus which can reduce the adverse effect the mist of the processing liquid or the insoluble substances formed by the processing liquid has on the ejection performance of the ink or processing liquid head during the process of printing that uses the ink and the processing liquid for rendering the ink insoluble.

According to one aspect, the present invention provides an ink jet printing apparatus which comprises: at least one ink head for ejecting an ink; a processing liquid head for ejecting a processing liquid, the processing liquid being adapted to render a colorant of the ink ejected from the ink head insoluble; and a diffusion means provided near the processing liquid head to diffuse mist of the ink and/or processing liquid ejected from the ink head and/or processing liquid head; wherein the ink head and the processing liquid head are moved relative to a print medium and eject the ink and processing liquid onto the print medium to perform printing.

In this invention, the diffusion means includes a head holding means, which holds and arranges a plurality of ink heads and a processing liquid head in a direction in which they move relative to the print medium and, in this arrangement, places the processing liquid head between the ink heads in such a way that a distance between the processing liquid head and the print medium is larger than any of distances between the plurality of ink heads and the print medium.

In this construction, because the processing liquid head is arranged between the ink heads and has a larger distance to the print medium than those of the ink heads, the processing liquid mist that may be produced as a result of ejection of the processing liquid mainly diffuses into the recessed space formed by the arrangement of these heads. Thus, the processing liquid mist hardly reaches the nozzle areas of the ink heads. Further, since the processing liquid head has a large distance to the print medium, the chances that the mist bounced off the print medium which includes insolubilized substances may reach the nozzle area of the processing liquid head can be reduced.

Hence, in the ink jet printing apparatus which performs printing by using the ink and the processing liquid that renders the ink insoluble, it is possible to reduce the effect the mist of the processing liquid or substances insolubilized by it has on the ejection performance of the processing liquid head.

In other words, this invention has been accomplished in light of the fact that the landing accuracy of the processing liquid does not have to be as high as those of the inks. That is, unlike the inks, the processing liquid does not directly form pixels and is not required to land with high precision on the intended positions on the print medium. The processing liquid therefore need only have a landing accuracy that will cause the landed processing liquid to mix with the ink dots to produce a predetermined level of an insolubilizing reaction.

The present invention therefore sets the head-to-paper distance—one of factors that determine the landing accuracy—of the processing liquid head larger than those of other heads, as described above, to form a recessed space between the ink heads adjoining the processing liquid head on both sides so that the processing liquid mist from the processing liquid head can diffuse or escape into this space, thus preventing the mist from reaching the nozzle surfaces of the other heads. The recessed space can also reduce the amount of the bounced-off mist generated by the ejection of the processing liquid that may adhere to the processing liquid head.

Further, the present invention is characterized in that the diffusion means has a head holding means, which holds and arranges a plurality of ink heads and the processing liquid head in such a way that a distance between the processing liquid head and an adjoining ink head is larger than a distance between other adjoining ink heads.

According to another aspect, the present invention is characterized in that the diffusion means has a head holding means, which holds the at least one ink head and the processing liquid head in such a way that a distance between the processing liquid head and an adjoining ink head is large enough to allow mist resulting from an ejection of the processing liquid from the processing liquid head to diffuse into a space defined by the distance.

According to still another aspect, the present invention is characterized in that the diffusion means comprises: a head holding means for holding the at least one ink head and the processing liquid head; and an air flow control means for controlling an air flow to diffuse mist, resulting from an ejection of the processing liquid from the processing liquid head, into a space formed between the processing liquid head and the ink head held by the head holding means.

According to one aspect of this invention, because the distance between the processing liquid head and the adjoining ink head is set larger than those between other ink heads, the mist produced from the ejection of the processing liquid and the mist produced by the ejected processing liquid bouncing off the print medium can be diffused in the space defined by the relatively large head-to-head distance. It is therefore possible to prevent the mist from adhering to the nozzles of the adjoining ink heads and the resultant insolubilized substances from causing an ejection failure of the ink heads.

According to another aspect of this invention, because the distance large enough to allow the diffusion of the mist is provided between the processing liquid head and the ink head, it is similarly possible to prevent the mist from adhering to the nozzles of the ink heads and the resultant insolubilized substances from causing an ejection failure of the ink heads.

According to a further aspect of this invention, because an air flow is generated in the space between the processing liquid head and the ink head to diffuse the mist, it is similarly possible to prevent the mist from adhering to the nozzles of the ink heads and the resultant insolubilized substances from causing an ejection failure of the ink heads.

As a result, the effect the processing liquid mist has on the ejection performance of the ink heads can be reduced, thus assuring good printing without any ejection failure.

The above and other objects, effects, features and advantages of the present invention will become more apparent from the following description of embodiments thereof taken in conjunction with the accompanying drawings.

BRIEF DESCRIPTION OF THE DRAWINGS

FIGS. 12A through 12C are conceptual diagrams illustrating how a dot is assumed to be formed when an ink droplet of a mixture of a pigment without dispersant and a dye is applied to the print medium and then reacted with the processing liquid, according to one embodiment of the present invention.

DETAILED DESCRIPTION OF PREFERRED EMBODIMENTS

Now, embodiments of the present invention will be described in detail by referring to the accompanying drawings.

(First Embodiment)

Figure 1:
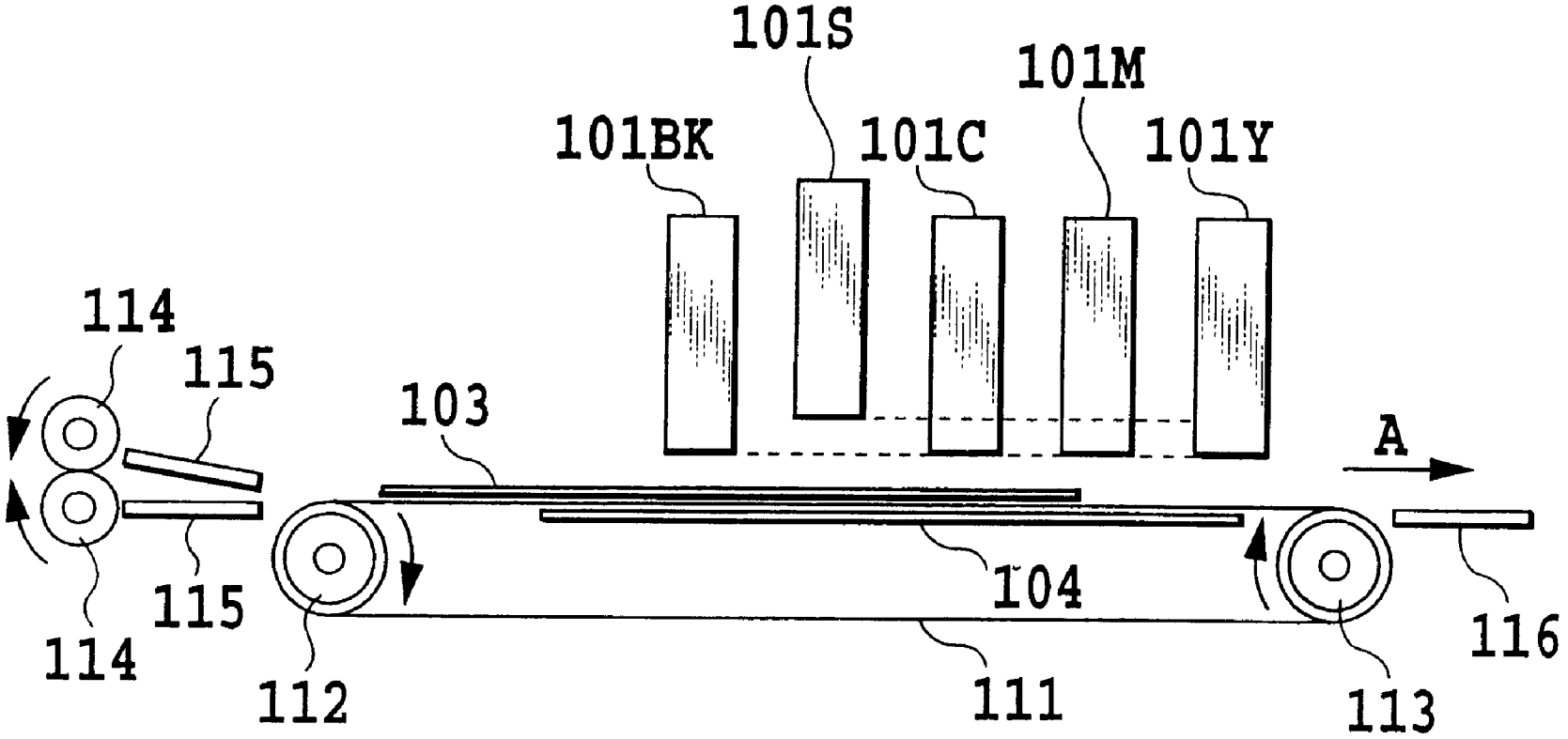
FIG. 1 is a side view schematically showing a construction of an ink jet printer according to a first embodiment of the present invention.

FIG. 1 is a side view schematically showing the construction of an ink jet printer that uses full-line type print heads in accordance with a first embodiment of the present invention.

The printer of this embodiment performs printing by ejecting ink or processing liquid from a plurality of full-line type print heads arranged at predetermined intervals in a print medium feed direction (indicated by arrow A). Overall printer operations, such as transport of the print medium and driving of print heads for ink or processing liquid ejection, and data processing associated with these operations are controlled by a control circuit not shown.

The printer of this embodiment has full-line type heads 101Bk, 101C, 101M, 101Y and 101S for black (Bk), cyan (C), magenta (M) and yellow (Y) inks and a processing liquid (S). Each of these heads has about 7,200 ink ejection nozzles arrayed in a direction of width of the print paper (i.e., in a direction perpendicular to a plane of the sheet of the drawing) that is fed in the direction of arrow A. With these heads, a sheet of up to A3 size can be printed. These print heads utilize thermal energy generated by heaters installed in liquid paths to form a bubble and eject the liquid by the pressure of the bubble.

The print paper 103 is fed in the direction of arrow A by the rotation of a pair of registration rollers 114 driven by a feed motor and is guided by a pair of guide plates 115 to align the paper's front end registration, then it is transported by a feed belt 111. The feed belt 111, an endless belt, is supported by two rollers 112, 113 and its upper part is restricted in a vertical displacement by a platen 104. The roller 113 is rotated by a driving source not shown such as a motor to transport the print paper 103. The print paper 103 is electrostatically attracted to the feed belt 111 and, while being carried on the feed belt 111, is applied with ink or processing liquid ejected from the heads and then discharged onto a stacker 116.

In the construction described above, the print heads eject their color inks and processing liquid onto the print medium being carried to print black characters and color images. The ink ejection performed as the print paper is carried will be described in more detail. As shown in FIG. 1, first the black ink is ejected from the head 101Bk, followed by the ejection of the processing liquid from the head 101S. In this embodiment, the processing liquid is ejected in response to the ejection of the black ink. This can enhance the density of black characters as well as their water resistance and also prevent the spreading of ink. The C, M and Y inks are ejected basically not related to the processing liquid.

In this embodiment, a distance between the nozzle surface, i.e., a surface where the nozzles are arranged, and the print medium (hereinafter referred to also as a paper distance) for the processing liquid head 101S is differentiated from those of the ink print heads to form an diffusion means. More specifically, as shown in FIG. 1, the paper distance of the head 101S is set larger than those of other heads, which are of equal magnitudes.

The diffusion means provides the following advantages. First, this construction has a predetermined space formed by the processing liquid head 101S and the adjoining heads 101Bk, 101C on both sides thereof, so that the mist produced by the ejection of the processing liquid from the head 101S but not reaching the print paper can float in this space. Hence, even when the processing liquid mist is produced as a result of ejecting the processing liquid, the mist mostly adheres to the side surfaces of the adjoining ink heads 101Bk and 101C and it is almost possible to prevent the mist from reaching their nozzle surfaces and from reacting with the ink in or around the nozzles to produce insoluble materials.

Second, with the diffusion means the mist mixed with the insolubilized material do not easily adhere to the nozzle surface of the processing liquid head. When the processing liquid is ejected onto a Bk ink dot, the bounced-off mist may include the liquid that has reacted with the Bk ink. If that mist adheres to the nozzle surface of the processing liquid head, a processing liquid ejection trouble may result, as was described in the case of the ink ejection. To deal with this problem, the paper distance may be increased to reduce the amount of the bounced-off mist adhering to the nozzle surface of the processing liquid head. Experiments conducted by the inventors of this invention have found that there is no problem when the paper distance of the processing liquid head is set larger than about 1.5 mm. Thus, in this embodiment, the paper distance of the processing liquid head is set at 1.5 mm and four other heads at 1.0 mm.

Increasing the paper distance of the processing liquid head will generally result in a reduced landing accuracy. The processing liquid, however, is ejected for rendering the Bk ink insoluble through its predetermined reaction with the Bk ink and it is therefore not necessarily required that the processing liquid land with high precision on those pixels to which the Bk ink is applied. That is, even when the landing positions of the processing liquid are deviated, as long as the deviations are within a range that ensures a predetermined reaction between the processing liquid and the Bk ink, the processing liquid can produce intended effects, such as improved density and water resistance of the black printed image. The inventor of this invention has taken this fact into consideration in realizing this embodiment as one example in which the position of the processing liquid head and its positional relation with other heads are determined so as to minimize the amount of the processing liquid mist or of the mist including insolubilized materials that adheres to the adjoining heads. If the processing liquid is made relatively highly penetrative, the reduction in the landing accuracy poses no problem. This is because, when a solid black area is printed for example, the ejected processing liquid can react with the Bk ink as it spreads over the surface of the densely distributed Bk ink droplets and penetrates into the paper.

(Second Embodiment)

Figure 2:
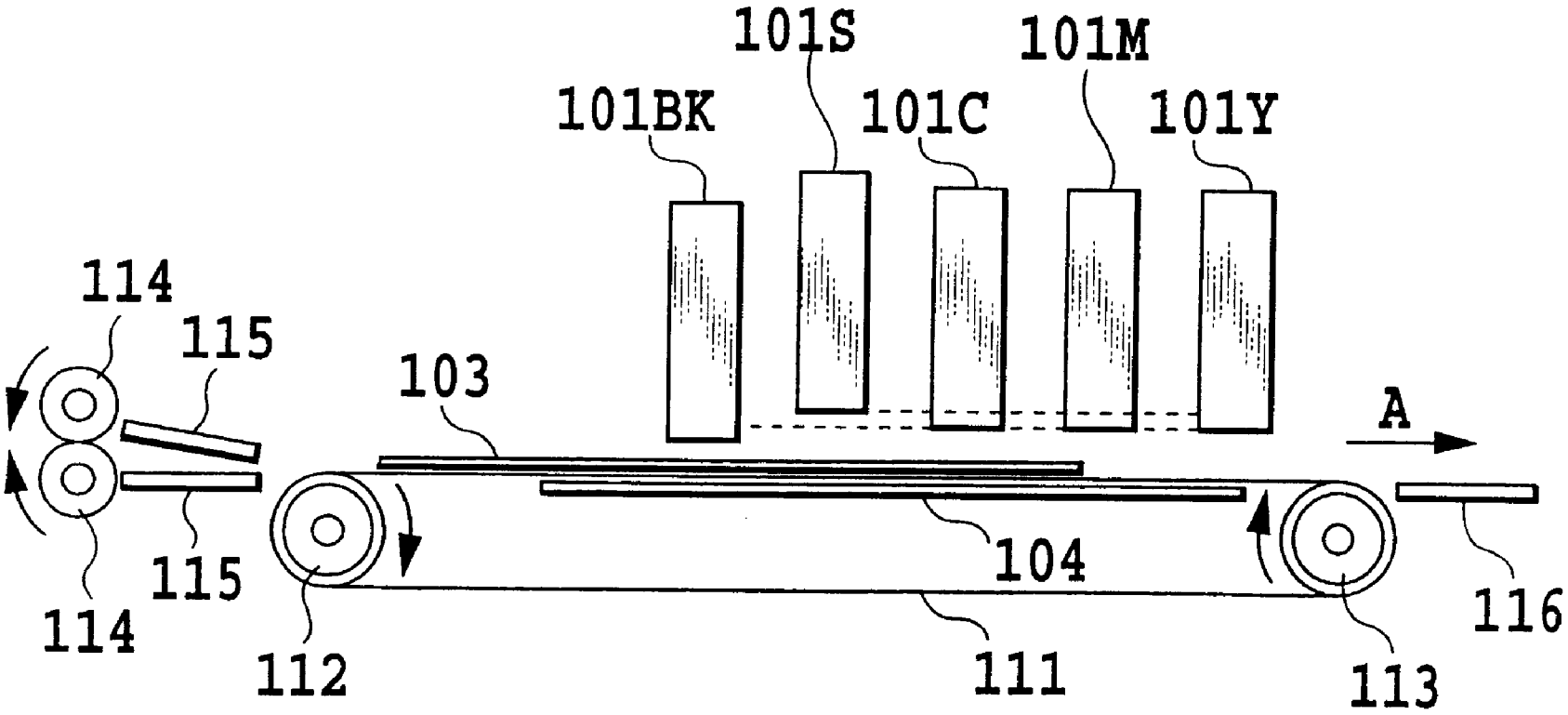
FIG. 2 is a side view schematically showing a construction of an ink jet printer according to a second embodiment of the present invention.

FIG. 2 is a side view schematically showing the construction of an ink jet printer according to a second embodiment of the invention. As shown in the figure, the printer of this embodiment has basically the same construction as the first embodiment, except that the paper distances for the individual print heads are different.

This embodiment is similar to the first embodiment in that the processing liquid head has the largest paper distance. This construction provides a space, similar to the one formed in the first embodiment, in which the processing liquid mist can float, thereby preventing the processing liquid mist from adhering to the nozzle surfaces of other heads and reducing the amount of bounced-off mist including insolubilized substances that adheres to the nozzle surface of the processing liquid head.

In addition to the effects described above, this embodiment can also provide another advantage of improving the landing accuracy of the Bk ink head, which in turn allows the amount of ink of the Bk head in particular to be reduced in comparison with its ordinary amount of ink and with those of other heads. More specifically, the paper distances of the print heads are determined as shown in FIG. 2. In addition to the above-described arrangement of the processing liquid head 101S, this embodiment sets the smallest paper distance for the Bk ink head 101Bk and larger but equal paper distances for the C, M, Y ink heads 101C, 101M, 101Y.

In this arrangement, the Bk ink head situated most upstream with respect to the paper feeding direction can be set with a reduced paper distance without having to give so much consideration to a so-called cockling problem, essentially a phenomenon in which the print paper waves due to absorption of moisture. This is because the cockling phenomenon, although it is caused by the ink ejection from the Bk ink head, becomes noticeable in the downstream of the Bk ink head as the print paper is carried.

Because a downstream head that is situated above the area in question when the cockling takes place is set with a larger paper distance than that of the Bk ink head, the cockled part of the paper can be prevented from contacting the nozzle surface of that head and damaging it.

Further, since the paper distance of the Bk ink head can be set relatively small, the amount of ink to be ejected can be reduced without having to give so much consideration to the landing accuracy problem. When the landing accuracy deteriorates, the ink may fail to land at intended positions on the paper where ink dots are to be formed, resulting in blank lines being formed in a printed image and a lower of density due to insufficient area factor. To alleviate this problem, conventional practice involves setting the amount of ink to be ejected slightly larger than required to increase the diameters of dots to be formed. Increasing the dot diameter, however, results in a significant increase in the amount of ink ejected.

This embodiment, however, can make the landing accuracy problem less serious by setting the paper distance of the Bk ink head relatively small, so that the amount of ink to be ejected from each head can be reduced according to the paper distance.

As to the blank lines, when an ink with a low penetration capability is used, ink droplets on the paper tend to shrink because of the surface tension, forming smaller dots. This makes the blank lines more likely to occur. With this embodiment, however, even when an ink with a low penetrating capability is used, it is possible to secure the landing accuracy and thereby reduce the possibility of formation of the blank lines by reducing the paper distance of the Bk ink head in particular.

Further, by reducing the amount of ink to be ejected, the total volume of ink applied to the entire print paper can also be reduced. This reduces the magnitude of cockling (e.g., height of a wavelike cockled portion) if it occurs at all and the speed at which it takes place. Further, because the force with which the print paper waves in the process of cockling becomes small, it is possible to reduce the attraction force when an electrostatic attraction method and air attraction method are employed for a print medium transport system. The reduced attraction force means that the electric field and the air pressure to generate the attraction force can also be reduced, which in turn makes it possible to minimize disturbances in the ejection direction of the ink droplets. Particularly when the electrostatic attraction method is employed, the fact that this embodiment requires only a small attraction force as described above is all the more advantageous because when the paper absorbs ink the attraction force itself decreases.

Further, reducing the amount of ink to be ejected when a Bk ink used has a low penetration capability is preferred for the following reasons. Generally, when the ink has a low print medium penetration capability, the fixing of the ink takes longer. But, because the amount of ink itself that is to be ejected is reduced, the time it takes for that amount of ink to penetrate into the paper is shorter than when the ordinary amount of ink is ejected. This can compensate for the low penetration capability.

Further, because the lower the penetration capability of the ink, the longer it takes from when a droplet lands on the paper until the cockling occurs, it is preferred that a head that is situated more on the upstream side with respect to the paper feed direction uses an ink with a lower penetration capability.

Further, in this case, when the amount of Bk ink ejected is small as described above, the black image has an improved sharpness at edge portions. This is because the reactive product formed by the reaction between the Bk ink and the processing liquid cannot easily flow out when the amount of ink is small. Further, even when the amount of Bk ink ejected is small as in this embodiment, an area factor of dots formed is large enough to make the optical density observed sufficiently high.

Furthermore, in this embodiment it is preferred to make the amount of processing liquid ejected smaller than the amount of Bk ink. This, in combination with the reduced amount of the Bk ink ejected, allows the Bk ink to penetrate into and be fixed at a relatively shallow depth in the paper near the surface.

Since the amount of Bk ink and the amount of the processing liquid used in printing a black image can be reduced as described above, it is possible to reduce the magnitude of cockling that may occur in the print paper as well as the speed at which the cockling takes place. This eliminates the need for setting the paper distances of other color heads unnecessarily large, which in turn minimizes a deterioration of color print quality that would result when the paper distance is set larger than normal.

In this embodiment, the paper distances are set at 0.5 mm for the Bk ink head, 1.5 mm for the processing liquid head, and 1.0 mm for C, M and Y heads.

Even when the amount of ink ejected is small, the area factor of the dots formed can be made sufficiently large as described above because the paper distance is also reduced at the same time.

(Third Embodiment)

Figure 3:
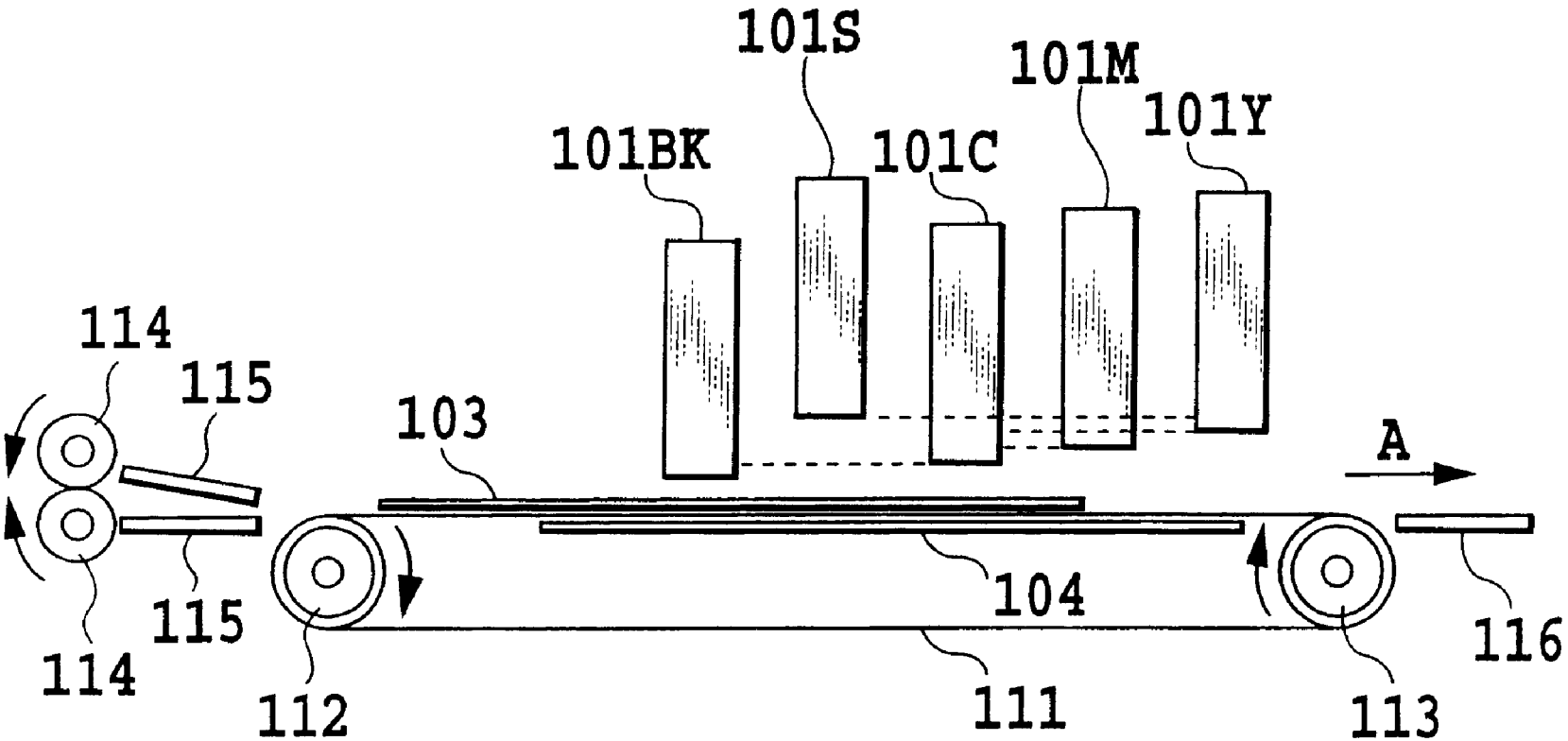
FIG. 3 is a side view schematically showing a construction of an ink jet printer according to a third embodiment of the present invention.

FIG. 3 is a side view schematically showing the construction of an ink jet printer according to a third embodiment of the present invention. The printer of this embodiment is similar in basic construction to the first and second embodiments, except for the paper distances of the print heads.

In this embodiment, the processing liquid head 101S has the largest paper distance, as in the preceding embodiments. This arrangement can reduce the effects the processing liquid mist and the bounced-off mist containing insolubilized substances have on other print heads.

This embodiment is characterized in that the paper distance progressively increases in the order of C, M and Y heads as shown in FIG. 3. This arrangement represents an example construction that can properly cope with the cockling which was described in connection with the second embodiment. That is, the cockling grows as the paper is fed downstream and the paper distance is set to increase accordingly so that an interference between the cockled part of the print paper and the head can be prevented adequately.

In this embodiment, the paper distance is set at 0.5 mm for the Bk ink head, 1.8 mm for the processing liquid head, and 1 mm, 1.2 mm and 1.5 mm for C, M and Y ink heads respectively. Because the paper distance is reduced at the same time that the amount of ink ejected is reduced, the area factor of the dots formed can be set sufficiently large.

(Fourth Embodiment)

Figure 4:
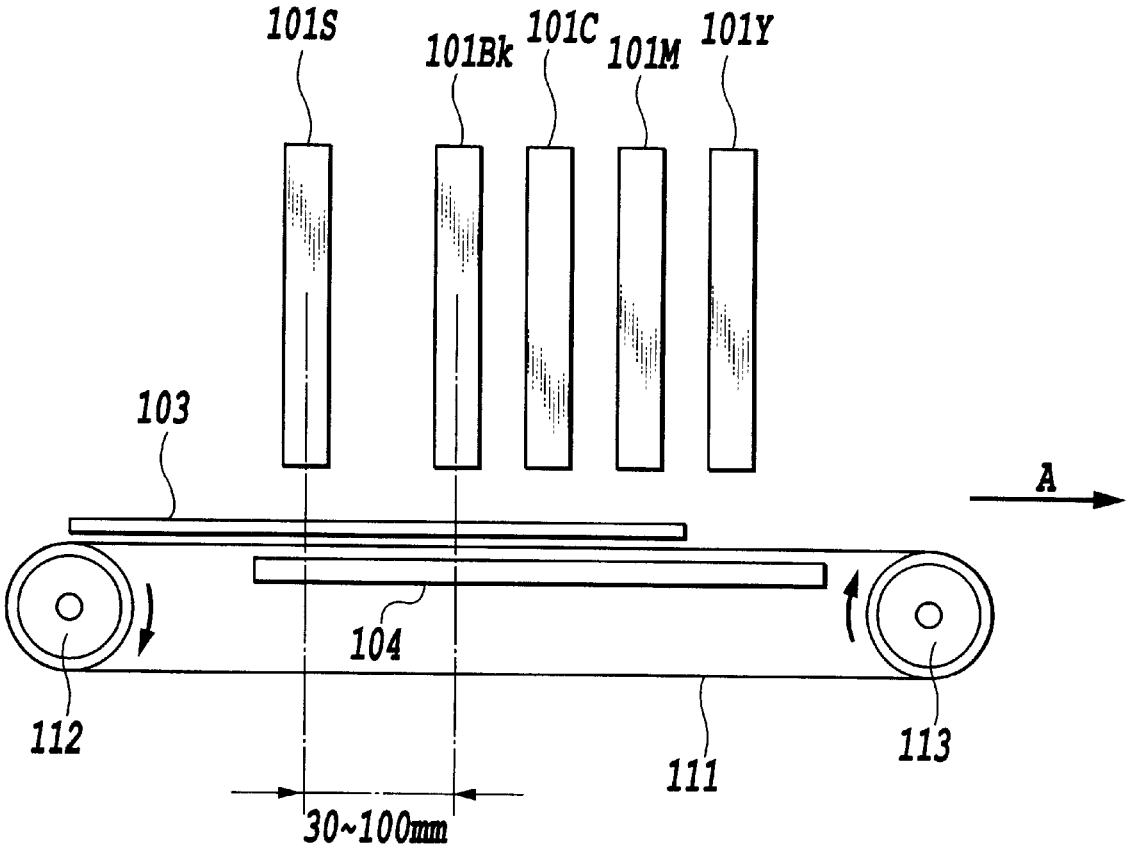
FIG. 4 is a side view schematically showing a construction of an ink jet printer according to a fourth embodiment of the present invention.

FIG. 4 is a side view schematically illustrating the construction of an ink jet printer using full-line type print heads according to a fourth embodiment of the present invention.

The printer of this embodiment has basically the same construction as the preceding embodiments, except for the arrangement of the print heads and the head-to-head interval. More specifically, as shown in FIG. 4, the processing liquid head 101S, black head 101Bk, cyan head 101C, magenta head 101M and yellow head 101Y are arranged in this order in the feed direction of the print paper 103. In the process of ejecting the inks as the print paper is fed, the processing liquid is first ejected from the head 101S, followed by the black ink from the head 101Bk. That is, in this embodiment, the ejection of the processing liquid corresponds to the ejection of the black ink. More specifically, the processing liquid is ejected to all pixels that are to be applied with the black ink or to a predetermined percentage of these black pixels. This arrangement can enhance the water resistance and the density of black characters and prevent the spreading of ink. The C, M and Y inks are ejected basically irrelevant to the ejection of the processing liquid.

As for the arrangement of the heads, the interval between the processing liquid head 101S and the downstream black head 101Bk in this embodiment is set to 30 mm or larger. The intervals between other adjoining heads are set smaller than 30 mm as in the conventional printer.

By setting the interval between the processing liquid head and the adjoining downstream head to larger than 30 mm, which is greater than normal, an diffusion means is formed. The processing liquid mist produced when the processing liquid is ejected from the head or bounced off the print paper is allowed to escape into a relatively large space, 30 mm or wider, formed between the processing liquid head and the adjacent downstream head 101Bk. In this space, the mist moves mainly upwards. This arrangement can prevent the processing liquid or the insolubilized substance produced by the reaction between the processing liquid and the ink from attaching to the nozzle surface of the head 101Bk. The diffusion of the mist into the space is facilitated by an air flow generated by the movement of the paper or belt and flowing upward because of the presence of this space. The air flow would normally move in the direction of movement of the paper and belt unless the diffusion space is provided.

A lower limit of the interval between the processing liquid head and the adjacent head (in this embodiment, 30 mm) varies depending on a system of the printing apparatus. This value may be obtained in advance with experiments by determining if the space with a certain head-to-head interval allows the mist to be effectively dispersed and moved upward.

An upper limit of the head-to-head interval may be determined considering a variety of factors, e.g., a size of the printing apparatus and cockling of the print paper (uneven deformations of the print paper as a result of absorbing ink and processing liquid).

Let us consider, for example, a cockled print medium in a printer that uses full-line print heads of this embodiment. It is desired that a cockled portion of the print paper is able to pass under a group of heads before the uneven deformations of the cockled portion grow, by absorbing the processing liquid and ink as the print paper is fed, to such a size that they interfere with the heads. If the speed of paper feeding is 170 mm/sec, for example, the interval that meets the above condition is preferably set to about 100 mm. Considering the printer size and the associated cost, the interval should preferably be set to 100 mm or less.

In this embodiment, therefore, the interval between the processing liquid head and the adjacent head on the downstream side is set in a range of between 30 mm and 100 mm.

(Fifth Embodiment)

This embodiment differs from the fourth embodiment in the order of arrangement of the heads. Hence, the large head-to-head interval formed between the processing liquid head and the adjacent downstream head in this embodiment is located at a different position than in the fourth embodiment.

Figure 5:
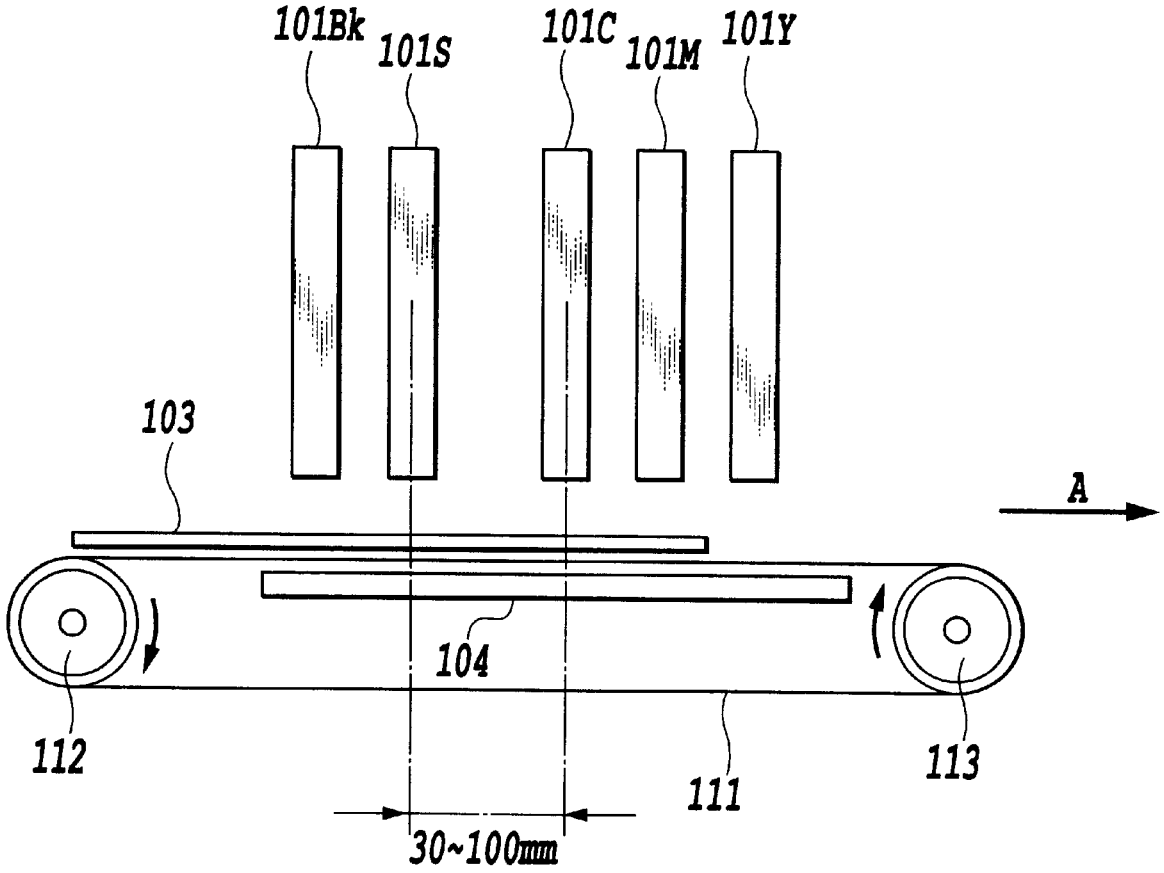
FIG. 5 is a side view schematically showing a construction of an ink jet printer according to a fifth embodiment of the present invention.

FIG. 5 is a side view schematically showing the construction of an ink jet printer according to this embodiment. As shown in the figure, the black head 101Bk, processing liquid head 101S, cyan head 101C, magenta head 101M and yellow head 101Y are arranged in that order in the feed direction of the print paper 103. In this arrangement, too, the processing liquid is ejected in a matching relationship with the black ink, as in the fourth embodiment, to improve the print quality of the black ink.

In this embodiment, the interval between the processing liquid head 101S and the adjacent cyan head 101C on the downstream side is also set to 30 mm or more to allow the processing liquid mist to escape into the space between these two heads, thereby reducing the amount of mist adhering to the nozzle surface of the cyan head 101C.

In this embodiment, it is found (in experiments) that if the black ink mist from the black head 101Bk arranged upstream of the processing liquid head 101S should attach to the nozzle surface of the processing liquid head, the ejection characteristic of the processing liquid head is not affected largely. Therefore, the interval between the processing liquid head and the black head need not be set as large as that between the processing liquid head and the cyan head.

In this embodiment, too, the head-to-head interval is set to 100 mm or less for the paper feeding speed of 170 mm/sec to prevent interference between the cockled portion of the paper and the head.

(Sixth Embodiment)

In addition to the predetermined size of head-to-head interval explained in connection with the fourth and fifth embodiment, this embodiment provides a fan which generates an upward air flow through a space formed by the head-to-head interval to facilitate the dispersion of the mist.

Figure 6:
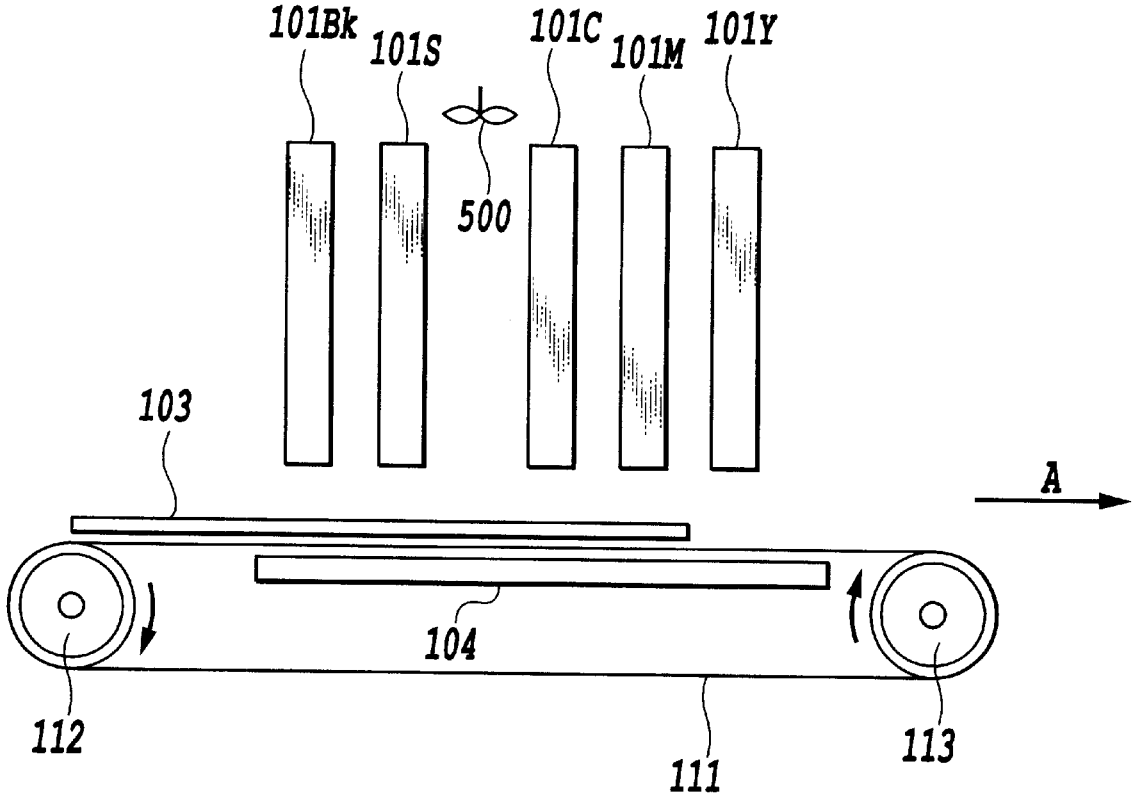
FIG. 6 is a side view schematically showing a construction of an ink jet printer according to a sixth embodiment of the present invention.
Figure 7:
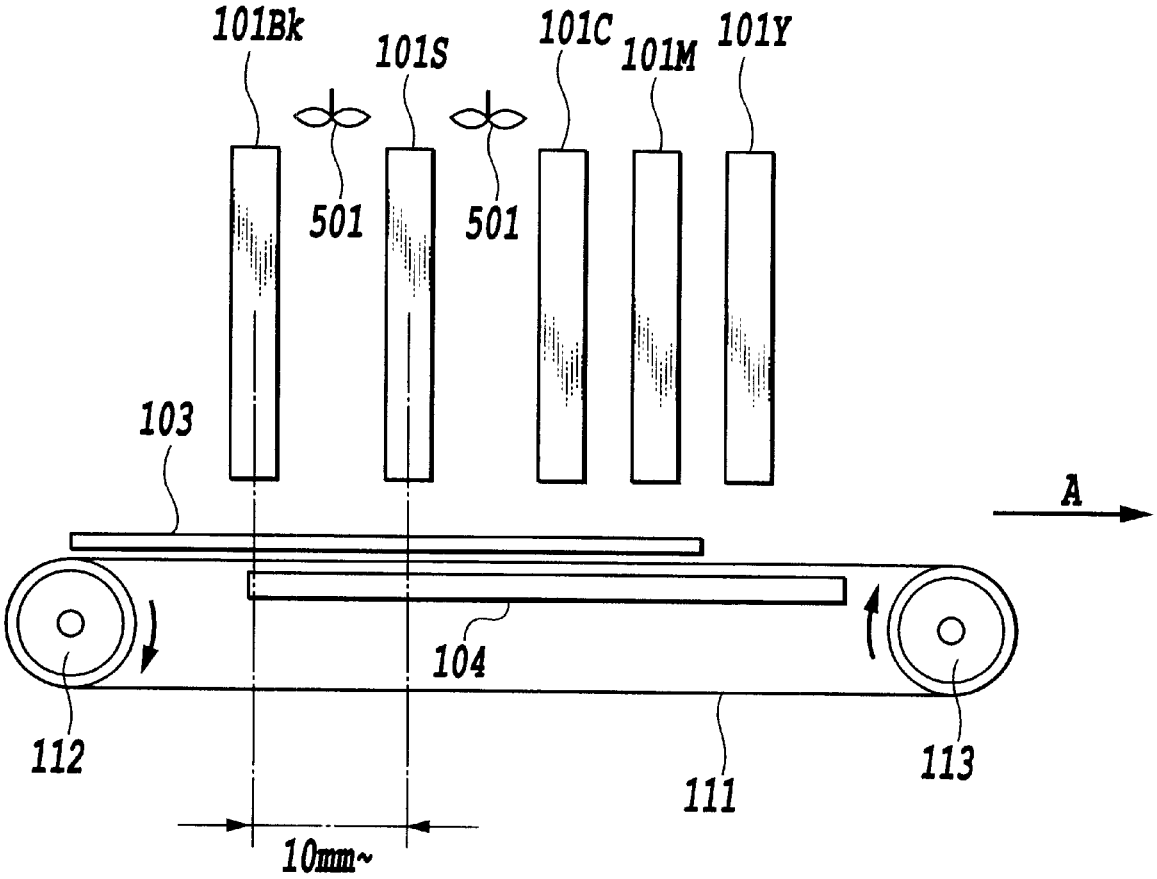
FIG. 7 is a side view schematically showing a construction of an ink jet printer according to a seventh embodiment of the present invention.

FIG. 6 is a side view schematically showing the construction of an ink jet printer of this embodiment. As shown in the figure, the order of arrangement of the heads is the same as that in the printer of the fifth embodiment shown in FIG. 5. Thus, the head located downstream of and adjoining the processing liquid head 101S is a cyan head 101C. Between these two heads an interval of a predetermined size is provided. In this embodiment, however, as described in the following, a fan for generating an air flow is installed in a space at this interval, so the interval may be smaller than those of the fourth and fifth embodiments. That is, the interval needs only to be of a size such that the air flow generated by the fan can efficiently move the mist upward.

In FIG. 6, the processing liquid head 101S and the cyan head 101C are arranged at a predetermined interval and a fan 500 is installed in an upper part of the space formed by this predetermined interval. Operating the fan generates an upward flow of air in the space, which in turn causes the mist generated by the ejection of the processing liquid from the head to move up.

With this embodiment, because the fan forcibly generates an air flow, the mist can be scattered away upward of the printer thus effectively preventing the mist from adhering to the adjoining heads.

(Seventh Embodiment)

This embodiment provides fans 501 one in each of spaces formed on both sides of the processing liquid head 101S with respect to the paper feeding direction.

This arrangement can reduce not only the effect the mist from the processing liquid head has on the downstream head but also the effect the mist from the black head located upstream of the processing liquid head has on the processing liquid head. When the ink mist from the upstream black head adheres to the nozzle surface of the processing liquid head, the ink mist reacts with the processing liquid leading to the processing liquid head failing to eject properly. To prevent this trouble a fan is also installed on the upstream side of the processing liquid head.

The construction of this embodiment can prevent the black ink mist from attaching to the processing liquid head and therefore the processing liquid head from failing to eject the liquid properly. This embodiment can also prevent the processing liquid mist from attaching to the color head on the downstream side and therefore the color head from failing to eject the ink properly.

The interval between the processing liquid head and the cyan head on the downstream side is the same as described in the sixth embodiment. The interval between the processing liquid head and the black head located on the upstream side is preferably set more than about 10 mm.

The compositions of the Bk ink and the processing liquid described in the first to the seventh embodiment are as follows. The percentage of each component is indicated in parts by weight.

| [Black (Bk) Ink] | |
|---|---|
| Pigment dispersion liquid | 25 parts |
| Food black 2 | 2 parts |
| Glycerine | 6 parts |
| Triethylene glycol | 5 parts |
| Acetylenol EH (Kawaken Fine Chemical) | 0.2 parts |
| Water | Remainder |

In the above composition the pigment dispersion liquid was obtained as follows.

To a solution of 5 g of concentrated hydrochloric acid dissolved in 5.3 g of water was added 1.58 g of anthranilic acid at 5° C. This solution was stirred in an ice bath at 10° C. or less, and then a solution of 1.78 g of sodium nitrite dissolved in 8.7 g of water at 5° C. was added. After stirring it for 15 minutes, 20 g of carbon black with a surface area of 320 $m^2/g$ and a DBP oil absorption of 120 ml/100 g was added in an "as-mixed" condition. Then, the solution was stirred for 15 minutes. The resultant slurry was filtered through a filter (Toyo Roshi No. 2 of Advantis make), and the pigment particles obtained were thoroughly washed with water and dried in an oven at 110° C. After this, water was added to the pigment to produce a pigment solution with a pigment concentration of 10 wt %. In this way the pigment dispersion liquid can be obtained which contains scattered self-dispersion type carbon black particles with their surfaces bonded with hydrophilic groups through phenyl groups and anion-charged.

| [Processing Liquid] | |
|---|---|
| Glycerine | 7 parts |
| Diethylene glycol | 5 parts |
| Acetylenol EH (Kawaken Fine Chemical) | 2 parts |
| Polyarylamine | 4 parts |
| Acetic acid | 4 parts |
| Benzalkonium chloride | 0.5 parts |
| Water | Remainder |

The amount of ink ejected from the Bk head is 18 pl for a pixel of 600 dpi and the amount of processing liquid is also 18 pl. The processing liquid is ejected to the pixels applied with the Bk ink at a culling rate of ½.

The ink used in the embodiments of this invention uses as a colorant a mixture of a dye and a self-dispersive pigment (hereinafter referred to also as a "pigment without dispersant.") The use of an ink with such mixed colorants can have the following advantages. First, because the ink containing a dye and a pigment without dispersant is used for printing, the low OD value caused by the dye ink is compensated for by the pigment to increase the OD value. Further, the reactive product produced by the mixing of the black ink and the processing liquid, which is applied following the black ink, can stay mostly in a top layer of the print medium, thus increasing the OD value.

Even when it takes long from an ink droplet landing on a print medium to the same ink dot being applied with the processing liquid, the use of a mixture ink with a slow penetration speed can increase the amount of colorant staying in a surface layer of the print medium and thereby raise the OD value. In other words, because of the effect produced by the use of a mixture ink containing a dye and a pigment without dispersant, which will be detailed later, the above-described problem caused by the individual use of a dye ink or a pigment ink can be eliminated or alleviated even when an ink with a slow penetration speed is used. This makes it possible to use a mixture ink with a still slower penetration speed. Therefore, a further increase in the OD value can be expected. A further effect of using an ink with a slow penetration speed includes preventing a so-called feathering phenomenon.

Figures 10A, 10B, 10C, 10D:
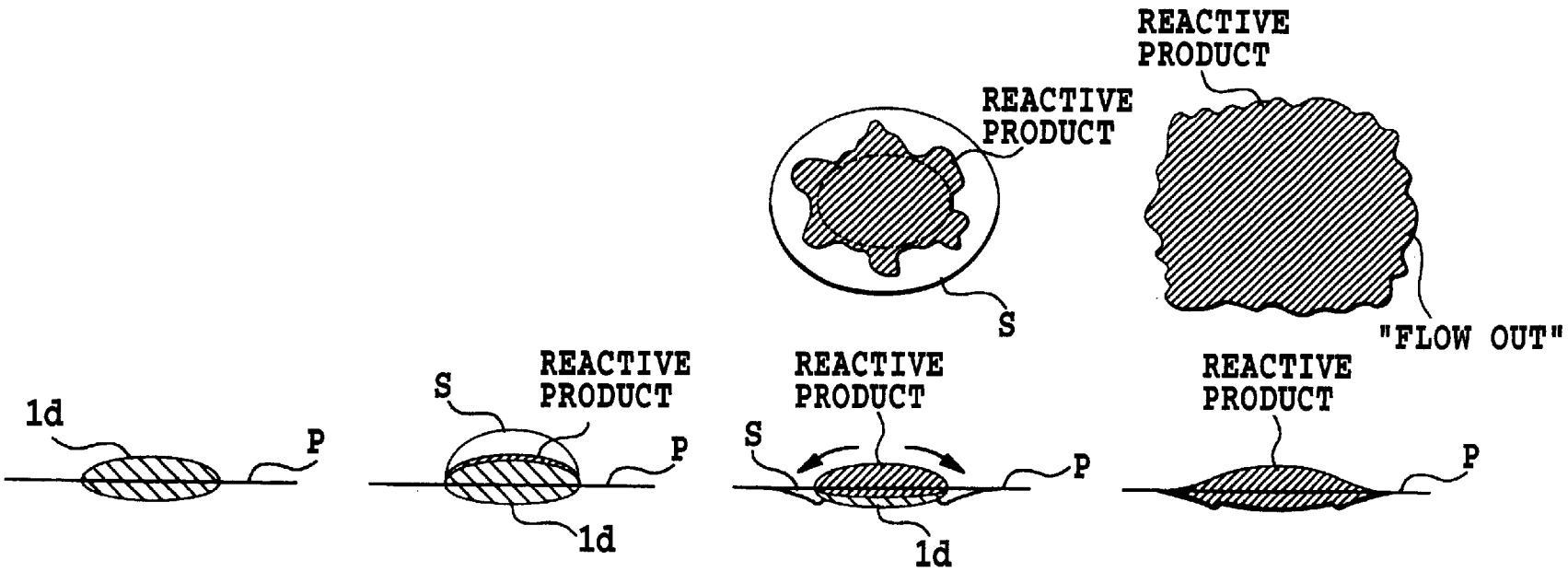
FIGS. 10A through 10D is a conceptual diagram assumedly illustrating a "flow out" phenomenon of reactive product produced as a result of reacting a dye ink with the processing liquid.
Figure 11C:
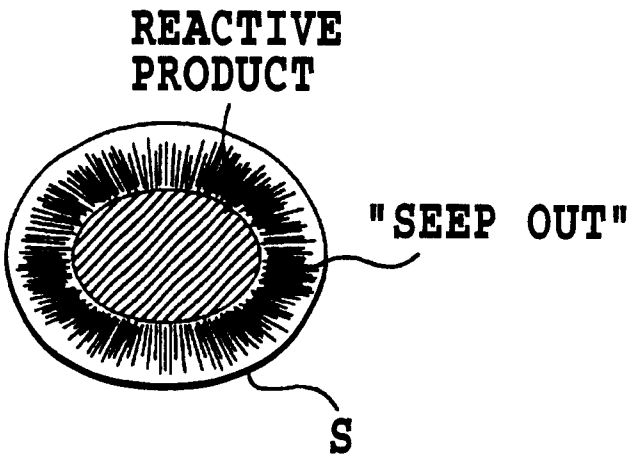
FIGS. 11A through 11C are conceptual diagrams assumedly illustrating a "seep out" phenomenon of reactive product produced as a result of reacting a pigment ink with the processing liquid.
Figure 11C:
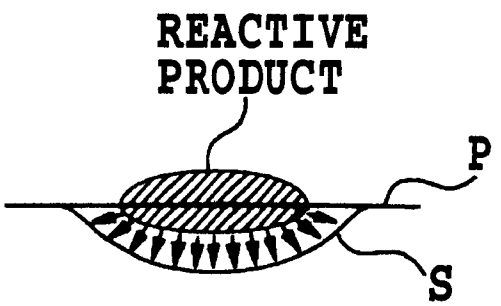

A second advantage offered by this embodiment applying a mixture ink first and then the processing liquid to the print medium is the ability to eliminate or alleviate both a problem called an "flow out" or "sweeping" phenomenon in connection with the dye ink as shown in FIG. 10D and a problem called a "seeping" or "blurring" phenomenon in connection with the pigment without dispersant as shown in FIG. 11C.

Figure 11B:
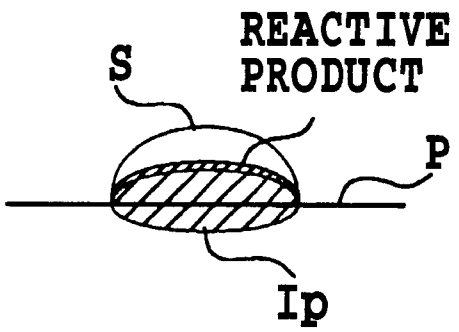
Figure 11A:
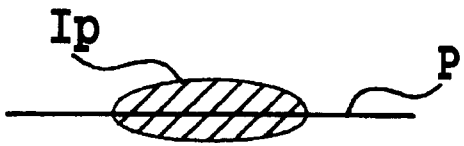

The inventor of this invention considers these advantageous effects to be produced in principle in the following manner. That is, when the print medium is first applied with a mixture ink and then with the processing liquid, the dye reacts with the processing liquid to form a highly viscous gel-like material. The pigment without a dispersant reacts with the processing liquid to cause a dispersive destruction. Fine pigment particles thus produced are taken into the highly viscous material of the dye reactive product. This is considered to minimize the "seeping" or "blurring" phenomenon in which the fine pigment particles flow out as the ink soaks into the print medium as shown in FIGS. 11A to 11C. The highly viscous material that has taken the pigment particles into it no longer has as high a fluidity as the reactive product formed by the reaction between the dye only and the processing liquid as shown in FIGS. 10A to 10C. Thus, the "flow out" or "sweeping" phenomenon is also considered to be prevented at the same time. In the arrangement in which a mixture of a dye and a pigment without dispersant is applied with the processing liquid, fine pigment particles produced by the dispersive destruction are taken into the gel-like dye reactive product. Hence, the fine pigment particles do not penetrate deep into the print medium but fills gaps between fibers of the print medium at a surface layer. Further, the gel-like dye reactive product also fills gaps between the particles taken in and smooths the uneven fiber surface of the print medium. This prevents diffused reflection of rays of light, which in turn makes the OD value higher than when a pigment alone and a processing liquid are used.

As described above, this embodiment can prevent the occurrence of a phenomenon that may degrade the print quality, such as "blurring" or "flow out" phenomenon schematically illustrated in FIGS. 12A to 12C, and at the same time produce an effect of increasing the OD value described above as the first advantageous effect.

The "blurring" or "flow out" phenomenon is likely to be caused by a pigment ink or a dye ink reacting with the processing liquid before these inks soak into the print medium. To prevent the occurrence of this phenomenon, therefore, the processing liquid must only be applied after the ink has penetrated into the print medium, giving rise to a problem that the print speed cannot be increased. In this embodiment, however, the use of a mixture ink itself of a dye and a pigment without dispersant can prevent the occurrence such as "blurring" phenomenon and hence there is no need to delay the timing of applying the processing liquid until the ink soaks into the print medium. Therefore this embodiment will not pose any problem in increasing the print speed. In other words, the OD value can further be increased by using a mixture ink of this embodiment with a relatively small penetration capability so that a colorant such as a pigment will stay as long as possible in a surface layer of the print medium.

As to the increase of the print speed, this embodiment when applied to an ink jet printing apparatus using full-line type heads can shorten the time taken from applying a mixture ink to applying the processing liquid. This in turn can increase the speed of a so-called first print, i.e., the printing of a first sheet of the print medium. The reduced time also allows the intervals between the print heads to be reduced, leading to a reduction in the size and cost of the printing apparatus.

The above-described effects can be obtained if the order of applying a mixture ink and a processing liquid in this embodiment is basically such that the black mixture ink is first applied to the print medium, followed by the processing liquid.

As described above, the mixture ink of this embodiment is applied prior to the processing liquid. The number of droplets of the mixture ink applied is not limited to one droplet as in the above examples.

For example, two droplets of a mixture ink may be applied prior to the processing liquid. In that case, it is preferred that, of the two droplets of the mixture ink, a droplet applied first have a greater ratio of a dye than that of a pigment without dispersant and a second droplet have a greater ratio of a pigment without dispersant. Hence, when the processing liquid is applied subsequently, a greater quantity of the pigment first reacts with the processing liquid, thus preventing that much further the out-flowing of the reactive product produced by the reaction between the dye and the processing liquid. In another example that can produce the similar effect, three droplets of the mixture ink may be ejected prior to the processing liquid and the pigment and dye ratio may be set such that the later the droplet is applied, the higher the ratio of the pigment without dispersant that droplet will have.

When the mixture ink is to be applied in a plurality of droplets as described above, the total amount of these ink droplets applied is set almost equal to that when the mixture ink is applied in one droplet. In other words, according to this embodiment of the present invention, when a droplet of the mixture ink is divided into a plurality of droplets when ejected, the predetermined effect described above can be obtained even if the amount of each droplet decreases according to the number of divisions.

As to the time difference between the ejection of the mixture ink and the ejection of the processing liquid in this embodiment, as long as the advantageous effects described above can basically be produced, any time difference falls within the scope of this invention, as in the case with the order of application of the ink and the processing liquid.

That is, depending on the time from the application of the mixture ink to the application of the processing liquid, the reaction between the mixture ink and the processing liquid can proceed in a variety of ways. For example, even when the time is short, a sufficient mixing between the pigment and the processing liquid takes place at a peripheral portion, or an edge portion, of each dot where the pigment and the processing liquid overlap, resulting in the advantageous effects of this embodiment. It was observed that at least the effect of preventing the "blurring" or "flow out" phenomenon was able to be produced.

In this respect, the "mixing" of the mixture ink and the processing liquid in this specification signifies not only the mixing over the entire dot but also the mixing at only a part of the dot, such as at an edge portion. Further, the present invention includes a case where the mixing takes place after the ink and the processing liquid have soaked into the print medium. All of these forms of mixing are defined as "mixing in a liquid state."

When a black mixture ink of this embodiment described above is used, carbon particles and a black dye, which are mixed and dispersed in liquid state and charged to the same polarity, react with a processing liquid containing polymers charged to the opposite polarity.

For the compositions of the black ink and the processing liquid described above, the C, M and Y inks have the following compositions.

| | |
|---|---|
| [Magenta (M) Ink] | |
| C.I. Acid Red 289 | 3 parts |
| Glycerine | 5 parts |
| Diethylene glycol | 5 parts |
| Acetylenol EH (Kawaken Fine Chemical) | 1 part |
| Water | Remainder |
| [Cyan (C) Ink] | |
| C.I. Direct Blue 199 | 3 parts |
| Glycerine | 5 parts |
| Diethylene glycol | 5 parts |
| Acetylenol EH (Kawaken Fine Chemical) | 1 part |
| Water | Remainder |

-continued

| [Yellow (Y) Ink] | |
|---|---|
| C.I. Direct Yellow 86 | 3 parts |
| Glycerine | 5 parts |
| Diethylene glycol | 5 parts |
| Acetylenol EH (Kawaken Fine Chemical) | 1 part |
| Water | Remainder |

Figure 8:
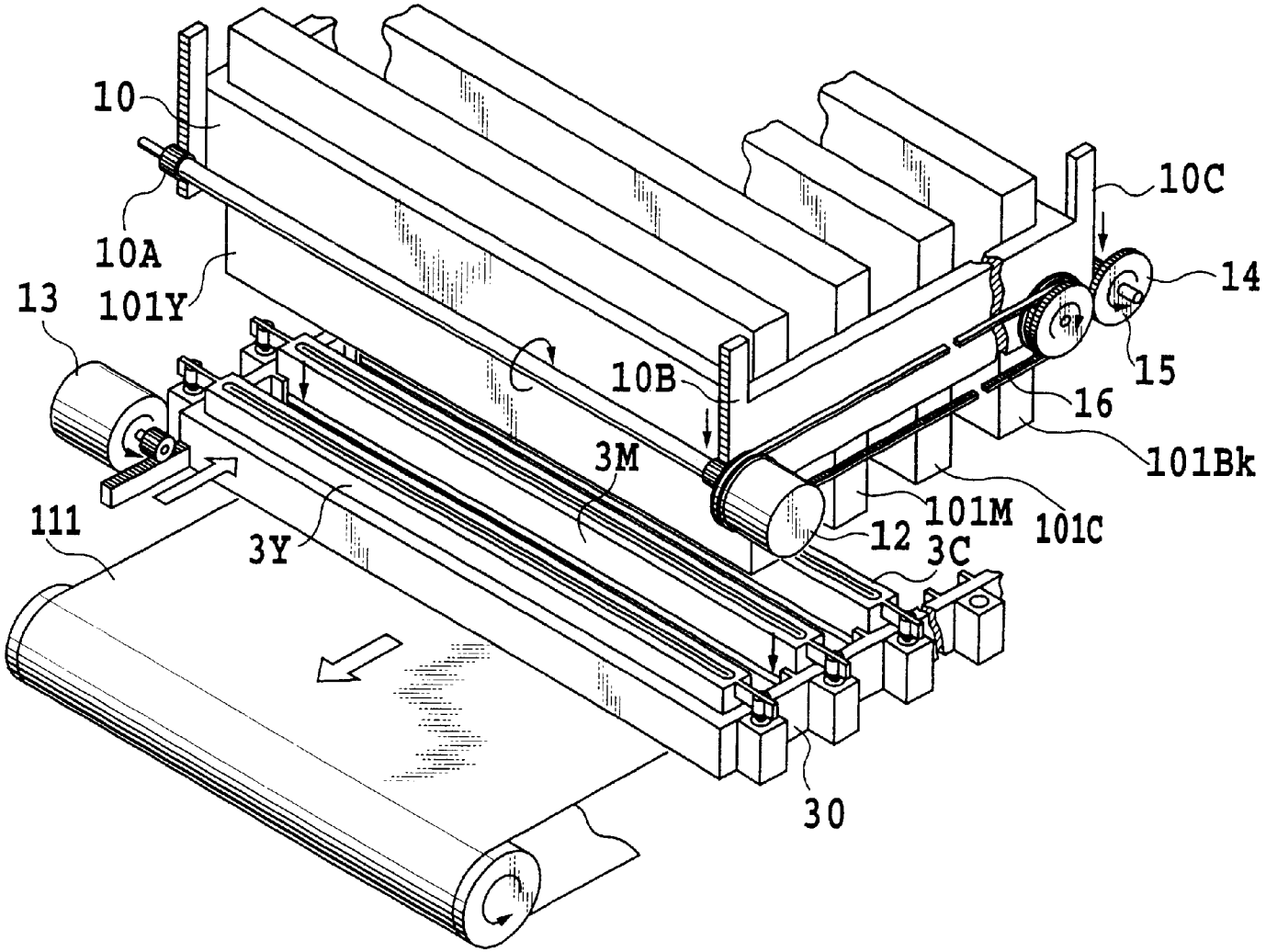
FIG. 8 is a perspective view showing head and cap moving mechanisms in the printers of the above embodiments.

FIG. 8 is a perspective view showing an example construction of an ink jet printer according to the first to the seventh embodiment described above. This illustrates details of moving mechanisms for the heads and caps in the printer. The figure shows four of the five print heads, with the processing liquid head 101S not shown.

A support frame 10 supporting the print heads are formed with racks 10A, 10B, 10C, 10D at four locations, with which gears are engaged to transmit a driving force of a motor 12 to move the support frame 10 up or down in the figure.

The distances between the heads supported on the support frame 10 and the print paper may be set to their predetermined distances as described above. The head-to-head intervals may also be set to their predetermined distances as described above. Further, both the head-to-paper distances and the head-to-head intervals may be set to their predetermined distances as described above.

The caps 3Y, 3M, 3C (caps for the processing liquid head and black head are not shown) are supported on another support frame 30. A rack on the support frame 30 and a gear for transmitting the driving force of the motor 13 are engaged to move the support frame 30 in a horizontal direction in the figure. In this construction, when the printing operation is not performed or when the ejection performance recovery operation is to be carried out, the caps are positioned to face the corresponding print heads for capping. For printing operation, the support frame 30 is moved horizontally to move the caps until the nozzle surfaces of the heads are situated between the caps. At the same time the support frame 10 is lowered so that the heads are at predetermined distances from the paper being fed.

(Other Embodiments)

In another embodiment of this invention, the heads 101C, 101M, 101Y shown in FIGS. 1 to 7 may be formed integral. That is, these three heads are formed in one piece, with the head-to-paper distances or the head-to-head intervals kept to the predetermined relationships described in the preceding embodiments. This construction is also included in this invention.

With this construction the distances between the C, M and Y heads can be reduced. That is, the time difference between the ejection timings of the color heads in applying their ink droplets onto the same portions of the print paper can be minimized. This ensures that the subsequent ejection can be made before a cockled portion of the paper, if it occurs at all as a result of the preceding ejection, can grow to interfere with the downstream heads. This construction renders the effect of the cockling negligible.

It is preferred that the color inks used have a high penetrating capability to prevent a bleeding phenomenon. Since the head-to-head distance is set small as described above, the increased speed of cockling growth due to the high penetration capability of the inks does not pose any problem.

In this embodiment the time difference between the ejections of the Bk head and other color ink heads is set to about 0.5–1 second. This setting is made to prevent the bleeding at the boundary between the Bk ink with low penetratability and the color inks with high penetratability. The cockling growth speed for the Bk ink is relatively slow and thus the ejection time difference can be set relatively large.

Although in the preceding embodiments we have described the construction that uses the full-line type heads, it should be noted that the present invention can also be applied to the construction using a serial type heads.

Figure 9:
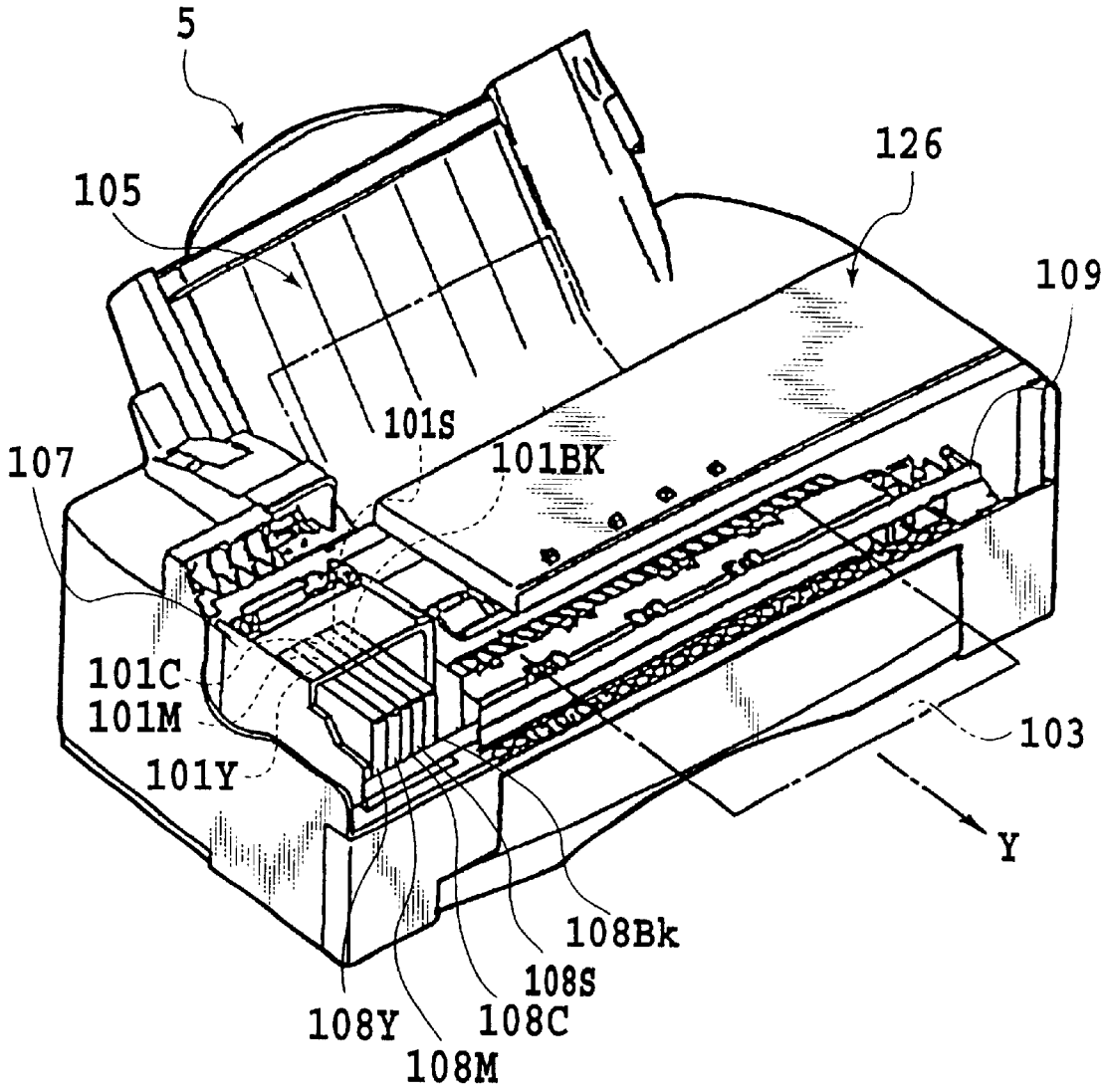
FIG. 9 is a perspective view showing an ink jet printer according to another embodiment of the present invention.

FIG. 9 is a perspective view of an example of the serial printer. Elements that are identical to those shown in FIGS. 1 to 7 are given like reference numbers and their explanations omitted.

The paper 103 as a print medium is inserted from a paper feeder 105 and moves past a print portion 126 before being discharged from the printer. In this embodiment, commonly used, inexpensive plain paper is used as the print paper 103. In the print portion 126, the carriage 107 is mounted in such a way that the distances between the paper and the print heads 101Bk, 101S, 101C, 101M, 101Y and/or the distances between these heads are kept to the relationships explained in connection with FIGS. 1 to 7. The carriage 107 is also reciprocally movable along a guide rail 109 by the operation of a motor not shown. The print head 101S has the distance relationships described above and ejects the processing liquid which was explained in the preceding embodiments. Similarly, the heads 101Bk, 101C, 101M, 101Y eject black ink, cyan ink, magenta ink and yellow ink, respectively. After the black ink is ejected, the processing liquid is ejected, followed by cyan, magenta and yellow ink in that order.

These heads are supplied the processing liquid or ink from the associated ink tanks 108Bk, 108S, 108C, 108M, 108Y. Ink is ejected as follows. A drive signal is fed to an electrothermal transducer (heater) provided in each nozzle in the heads to apply thermal energy generated to the ink or processing liquid to produce a bubble. The pressure of the bubble being generated expels a droplet of ink or processing liquid out of the nozzle. Each head has 64 nozzles at a density of 360 dpi. These nozzles are arrayed in almost the same direction in which the paper 103 is fed, i.e., in a direction almost perpendicular to the direction in which the heads are scanned.

In the construction described above, for example, in the first to third embodiments, the head-to-head distance is 1 inch and thus the distance between the head 101Bk and the head 101S is 1 inch. Since the print density in the scan direction is 720 dpi and the ejection frequency of each head is 7.2 kHz, the time it takes from when the black ink is ejected from the head 101Bk until the processing liquid is ejected from the head 101S is 0.05 second.

The print method of this embodiment is a one-pass one-way printing. The present invention can also be applied to a printing apparatus using a so-called multipass printing method in which the same print area is printed in two or more scan operations.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus comprising:

a plurality of ink heads for ejecting inks;

a processing liquid head for ejecting a processing liquid, the processing liquid being adapted to render a colorant of the inks ejected from the ink heads insoluble; and wherein the ink heads and the processing liquid head eject the inks and processing liquid respectively onto the print medium to perform printing, the ink jet printing apparatus further comprising:

relative moving means for moving the plurality of ink heads and the processing liquid head relative to a print medium; and wherein the relative moving means holds and arranges the plurality of ink heads and the processing liquid head in a direction in which they move relative to the print medium and, in this arrangement, places the processing liquid head between the ink heads in such a way that a distance between the processing liquid head and the print medium is larger than any of distances between the plurality of ink heads and the print medium.

2. An ink jet printing apparatus according to claim 1, wherein the plurality of ink heads are used for a plurality of inks including a black ink.

3. An ink jet printing apparatus according to claim 2, wherein the head holding means holds the plurality of heads so that the black ink head is most upstream among the heads in the direction in which they move relative to the print medium.

4. An ink jet printing apparatus according to claim 3, wherein the head holding means holds the plurality of heads so that the distances to the print medium of the ink heads are all equal.

5. An ink jet printing apparatus according to claim 3, wherein the head holding means holds the plurality of heads so that the distances to the print medium of the ink heads other than the black ink head are all equal and larger than the distance to the print medium of the black ink head.

6. An ink jet printing apparatus according to claim 3, wherein the head holding means holds the plurality of heads in such a way that the distances to the print medium of the ink heads other than the black ink head increase toward a downstream side in a direction in which the heads move relative to the print medium.

7. An ink jet printing apparatus according to claim 2, wherein the inks other than the black ink are cyan, magenta and yellow inks.

8. An ink jet printing apparatus according to claim 1, wherein the plurality of the ink heads and the processing liquid head are full-line heads whose nozzles are arranged in a direction of width of the print medium over which the heads move relatively.

9. An ink jet printing apparatus according to claim 1, wherein the plurality of the ink heads and the processing liquid head are serial heads whose nozzles are arranged in a direction almost perpendicular to a direction in which the heads move relative to the print medium.

10. An ink jet printing apparatus according to claim 2, wherein an amount of the black ink ejected from the black ink head is set smaller than that of the processing liquid head.

11. An ink jet printing apparatus according to claim 2, wherein the plurality of the ink heads and the processing liquid head utilize thermal energy to generate a bubble in the ink or the processing liquid and eject the ink or the processing liquid by a pressure of the bubble.

* * * * *

UNITED STATES PATENT AND TRADEMARK OFFICE

CERTIFICATE OF CORRECTION

PATENT NO. : 6,550,882 B2
DATED : April 22, 2003
INVENTOR(S) : Koitabashi et al.

It is certified that error appears in the above-identified patent and that said Letters Patent is hereby corrected as shown below:

Title page,
Item [56], References Cited, FOREIGN PATENT DOCUMENTS,
"54048552" should read -- 54-48552 --.

Column 5,
Line 47, "an" should read -- a --.

Column 6,
Line 3, "trouble" should read -- problem --.

Column 7,
Line 19, "lower" should read -- lower level --.

Column 8,
Line 5, "uses" should read -- use --.

Column 9,
Line 29, "an" should read -- a --; and
Line 59, "is" should read -- be --.

Column 10,
Line 42, "embodiment," should read -- embodiments, --.

Column 12,
Line 47, "an" should read -- a --.

Column 13,
Line 7, "fills" should read -- fill --; and
Line 66, "that much further" should read -- much further of --.

Column 15,
Line 44, "integral." should read -- integrally. --.

UNITED STATES PATENT AND TRADEMARK OFFICE

CERTIFICATE OF CORRECTION

PATENT NO. : 6,550,882 B2
DATED : April 22, 2003
INVENTOR(S) : Koitabashi et al.

It is certified that error appears in the above-identified patent and that said Letters Patent is hereby corrected as shown below:

Column 16,
Line 3, "pentratability" should read -- penetrability --, and "penetratability." should read -- penetrability. --;
Line 10, "a" should be deleted; and
Line 31, "ink" should read -- inks --.

Signed and Sealed this

Tenth Day of February, 2004

JON W. DUDAS
*Acting Director of the United States Patent and Trademark Office*